US007098612B2

(12) United States Patent
Huang et al.

(10) Patent No.: US 7,098,612 B2
(45) Date of Patent: Aug. 29, 2006

(54) FREQUENCY SYNCHRONIZATION DEVICE FOR LCD LAMPS

(75) Inventors: Shih-Chung Huang, Taipei (TW); Chien-Cheng Yang, Taoyuan (TW); Tim Yu, Banciao (TW)

(73) Assignee: Beyond Innovation Technology Co., Ltd., Taipei (TW)

( * ) Notice: Subject to any disclaimer, the term of this patent is extended or adjusted under 35 U.S.C. 154(b) by 0 days.

(21) Appl. No.: 11/226,938

(22) Filed: Sep. 14, 2005

(65) Prior Publication Data

US 2006/0071617 A1 Apr. 6, 2006

Related U.S. Application Data

(63) Continuation-in-part of application No. 10/670,729, filed on Sep. 26, 2003, now Pat. No. 6,963,179.

(51) Int. Cl.
*H05B 37/00* (2006.01)

(52) U.S. Cl. ..... 315/318; 315/209 R; 315/224; 315/291; 315/325; 345/102; 345/213; 349/70

(58) Field of Classification Search ..... 315/312, 315/318, 325, 276–278, 209 R, 291, 297, 315/307, 224; 345/102, 213, 211, 212, 87, 345/92; 349/61, 70

See application file for complete search history.

(56) References Cited

U.S. PATENT DOCUMENTS 6,420,839 B1 * 7/2002 Chiang et al. ..... 315/311
6,750,842 B1 * 6/2004 Yu ..... 345/102
6,812,916 B1 * 11/2004 Hwang ..... 345/102

* cited by examiner

*Primary Examiner*—Haissa Philogene

(57) ABSTRACT

A frequency synchronization device for a large LCD having a plurality of lamps as a background light source is disclosed. The device comprises a power amplification unit wherein one power amplification unit is electrically coupled to another amplification unit, each power amplification unit being electrically coupled to one or more of the lamps, adapted to generate a driving signal, and adapted to send the driving signal to the coupled lamp(s) for causing the lamps to operate at the same frequency; a plurality of current sampling elements each electrically coupled to one or more of the lamps for sampling current thereof; and control means comprising a control element and a diode, the control means being electrically coupled to current sampling elements so as to stabilize the current of the lamps. The connection and circuitry of the device are much simplified and improved.

20 Claims, 7 Drawing Sheets

FREQUENCY SYNCHRONIZATION DEVICE FOR LCD LAMPS

CROSS REFERENCE TO RELATED APPLICATIONS

The present application is a continuation-in-part application of U.S. Ser. No. 10/670,729, filed Sep. 26, 2003 now U.S. Pat. No. 6,963,179.

FIELD OF THE INVENTION

The present invention relates to LCDs (liquid crystal displays) and more particularly to an improved frequency synchronization device for an LCD having a plurality of lamps (e.g., fluorescent lamps) as background light source.

BACKGROUND OF THE INVENTION

LCDs are gaining popularity in recent years. Also, more LCDs having a larger screen size are commercially available. Further, applications of LCD are diversified. A typical application thereof is LCD TV (television). It is understood that light intensity of LCD background is required to increase for improving video quality as the screen size of LCD increases. Accordingly, more lamps (e.g., fluorescent lamps) are mounted in LCD for providing a sufficient light intensity of LCD background.

Conventionally, frequency synchronization among a plurality of lamps is required in controlling the operation of LCD lamps. Otherwise, a difference frequency distortion may occur between any two adjacent lamps, resulting in a flickering of the LCD screen.

Typically, ICs (integrated circuits) are used for controlling a frequency synchronization operation of the plurality of lamps. Such controlling is called active synchronous drive. The provision of a plurality of ICs is for the purpose of carrying out frequency synchronization among the lamps in operation. In detail, the ICs operate to output driving signals of the same frequency to respective lamps so that all lamps can operate in the same frequency.

A well known frequency synchronization device for an LCD having a plurality of LCDs (three as shown) is shown in FIG. 1. For any single lamp (e.g., first lamp 14*a*) (i.e., single lamp operation implementation), associated components such as a control element 11*a*, a driving element 12*a*, and a first power amplification unit 13*a* are provided. The control element 11*a* is adapted to control current of the first lamp 14*a* and provide protection against open circuit. Output signals of the control element 11*a* are sent to the first power amplification unit 13*a* for driving via the driving channel 12*a*. The first power amplification unit 13*a* comprises a DC (direct current) power 131*a*, a first power switch 132*a*, and a transformer 133*a* in which the first power switch 132*a* is adapted to convert DC into AC (alternating current) prior to outputting to the transformer 133*a*, and the transformer 133*a* is adapted to boost the AC voltage for activating the first lamp 14*a*. Each of the control elements 11*a*, 11*b* and 11*c* is implemented as an IC. Further, a synchronous signal bus 10 is provided to connect all of the control elements 11*a*, 11*b* and 11*c* together while providing synchronous signals thereto. Thus, all lamps 14*a*, 14*b* and 14*c* can operate at the same frequency as driven by synchronous signals fed from the control elements 11*a*, 11*b* and 11*c* via the driving channel 12*a*, 12*b* and 12*c* and the first, second and third power amplification units 13*a*, 13*b*, and 13*c* respectively.

Timing among the control elements 11*a*, 11*b*, and 11*c* is controlled by the synchronous signal bus 10. As such, the IC based control elements 11*a*, 11*b*, and 11*c* are very complicated in the design phase for achieving the timing control purpose. To the worse, more control elements are required as the number of lamps increases. This may further complicate the circuitry for controlling such many lamps. Also, associated components are required to operate in conjunction with IC based control elements for carrying out frequency synchronization. This can incorporate an excessive number of components in the circuitry and greatly increase the manufacturing cost. Thus, the need for improvement still exists.

SUMMARY OF THE INVENTION

It is an object of the present invention to provide a frequency synchronization device for a large LCD having a plurality of lamps as a background light source, comprising a plurality of power driving assemblies wherein one power driving assembly is electrically coupled to another power driving assembly, each power driving assembly being electrically coupled to one or more of the lamps, adapted to generate a driving signal, and adapted to send the driving signal to the coupled lamp(s) for causing the lamps to operate at the same frequency; a plurality of current sampling elements each electrically coupled to one or more of the lamps for sampling current thereof; and control means comprising a control element and a diode, the control means being electrically coupled to current sampling elements so as to stabilize the current of the lamps. By utilizing the present invention, following advantages are obtained. A secondary winding of multicoil of a transformer is used as means for initiating and sending driving signals to the lamps so that all lamps can operate in the same frequency. Driving signals having the same frequency can be generated without the provision of ICs as experienced in the prior art. Both connection and circuitry of the frequency synchronization device are much simplified. The driving signals having the same frequency are generated by a resonant chamber consisting of transformers and capacitors. Typical lighting loop of a plurality of fluorescent lamps are incorporated into the circuitry of the present invention and are improved by the present invention. Availability of constituent components is much easy and thus the manufacturing cost is reduced significantly. It is applicable to an LCD having more than two lamps. Lamp current can be effectively controlled and stabilized by incorporating a cost-effective lamp control circuit. Finally, it is much simplified in terms of the frequency synchronization control of lamps.

The above and other objects, features and advantages of the present invention will become apparent from the following detailed description taken with the accompanying drawings.

DETAILED DESCRIPTION OF THE PREFERRED EMBODIMENTS

Figure 2:
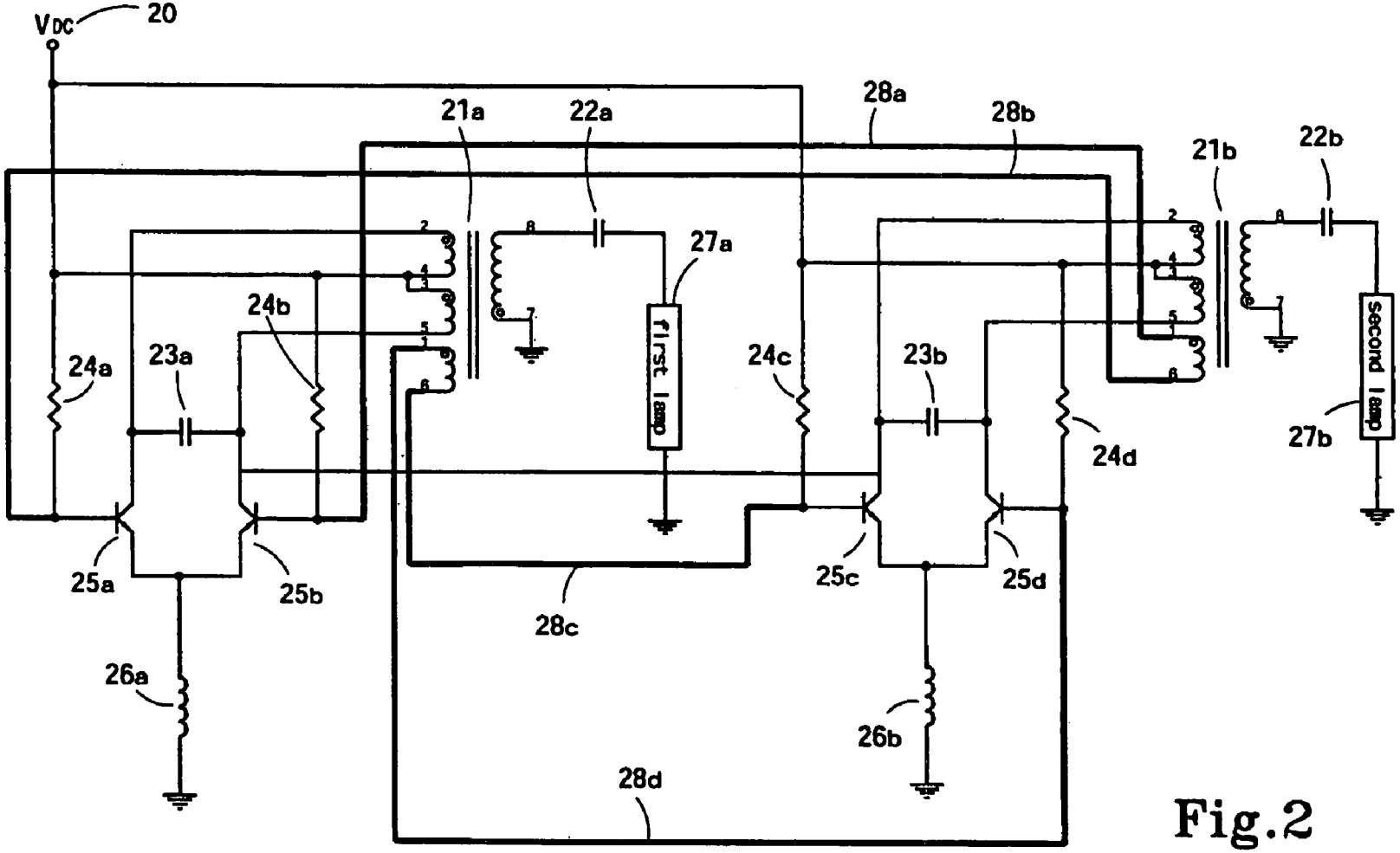
FIG. 2 is a schematic drawing of the driving circuitry of a frequency synchronization device for LCD that uses two lamps according to the invention.

Referring to FIG. 2, there is shown a driving circuitry of a frequency synchronization device for an LCD that uses two lamps according to the invention. As shown, a power driving assembly of a first lamp 27*a* comprises a DC power 20, power amplification elements 25*a* and 25*b*, capacitors 22*a* and 23*a*, an inductor 26*a* and a transformer 21*a*. Likewise, a power driving assembly of a second lamp 27*b* comprises the DC power 20, power amplification elements 25*c* and 25*d*, capacitors 22*b* and 23*b*, an inductor 26*b* and a transformer 21*b*. The characteristics of the invention are detailed as follows. Driving signals of the power amplification elements 25*a* and 25*b* are fed from a portion of a secondary winding of multicoil (i.e., from pins 1 and 6) of the transformer 21*b*. Output signals of the transformer 21*b* are sent from pin 1 to the power amplification element 25*b* for conducting via a conducting wire 28*a*. Also, output signals of the transformer 21*b* are sent from pin 6 to the power amplification element 25*a* for conducting via a conducting wire 28*b*. Similarly, driving signals of the power amplification elements 25*c* and 25*d* are fed from a portion of a secondary winding of multicoil (i.e., from pins 1 and 6) of the transformer 21*a*. Output signals of the transformer 21*a* are sent from pin 1 to the power amplification element 25*d* for conducting via a conducting wire 28*d*. Also, output signals of the transformer 21*a* are sent from pin 6 to the power amplification element 25*c* for conducting via a conducting wire 28*c*. In configuring as above, the first lamp 27*a* and the second lamp 27*b* can be operated at the same frequency. In addition, it is well-known that a power driving assembly could actually provide power to one or more lamp. We describe the embodiments with one power driving assembly to one lamp for easily describing, not limiting the applications of the present invention.

Figure 1:
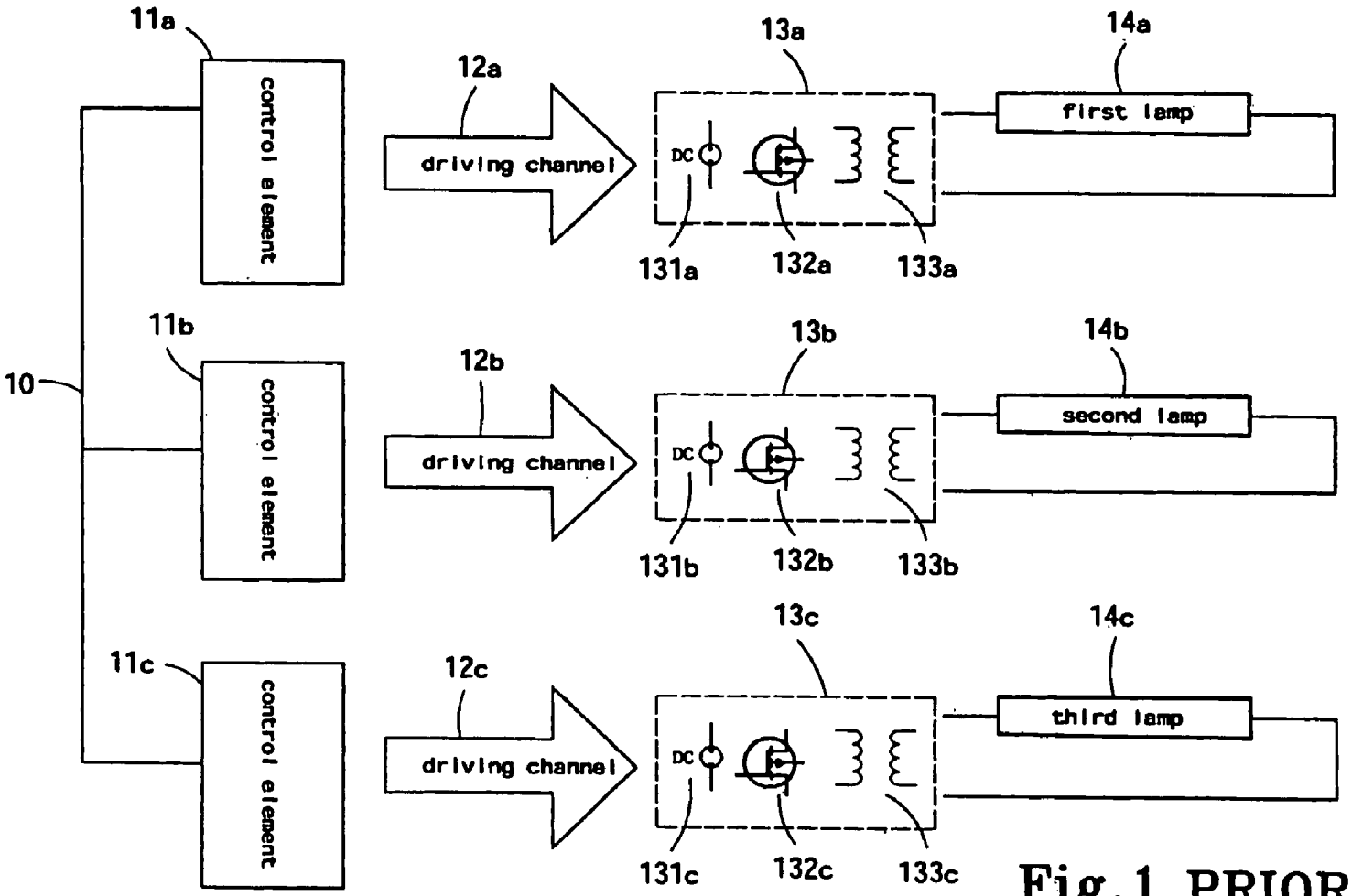
Fig.1 PRIOR ART
FIG. 1 is a schematic block diagram of a conventional frequency synchronization device for LCD lamps.
Figure 3:
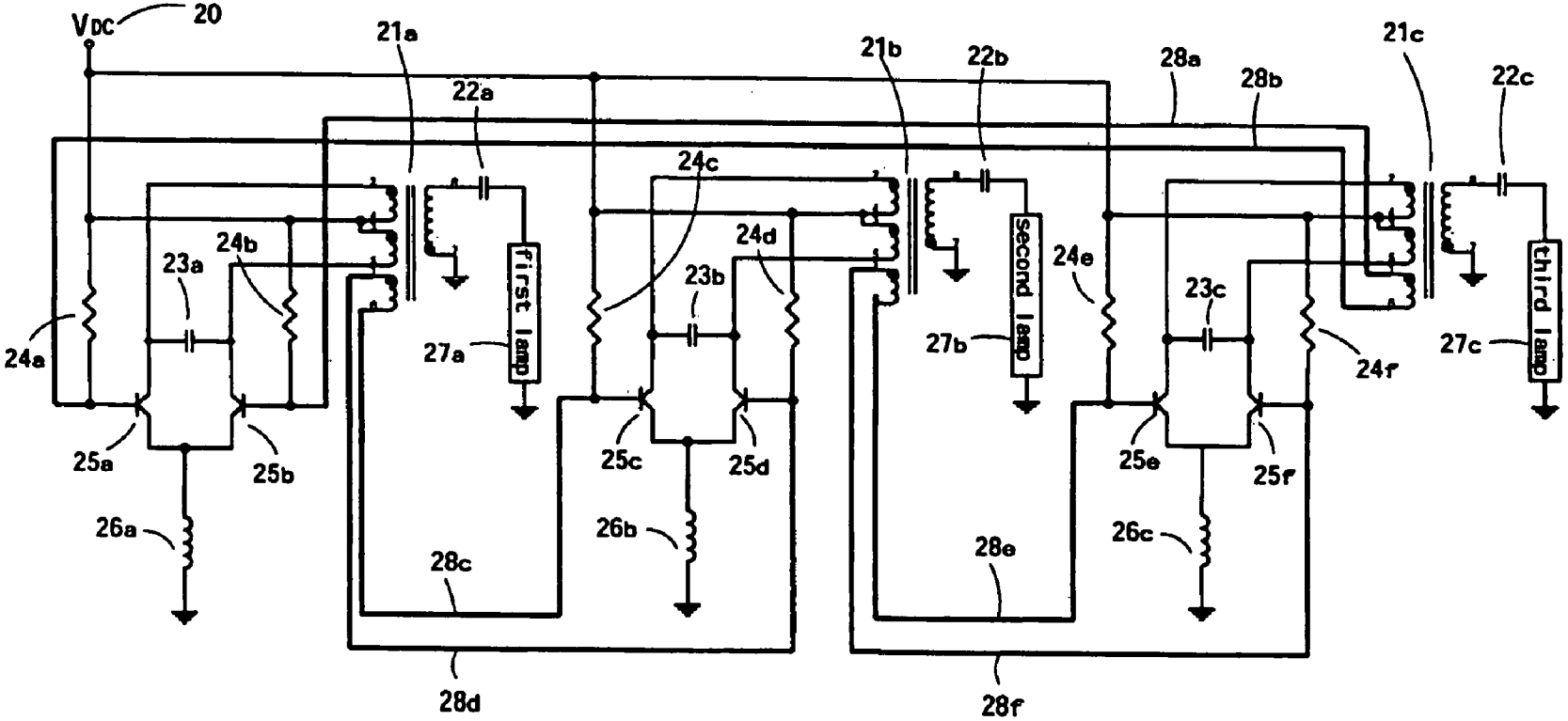
FIG. 3 is a schematic drawing of the driving circuitry of a frequency synchronization device for LCD that uses three lamps according to the invention.
Figure 4:
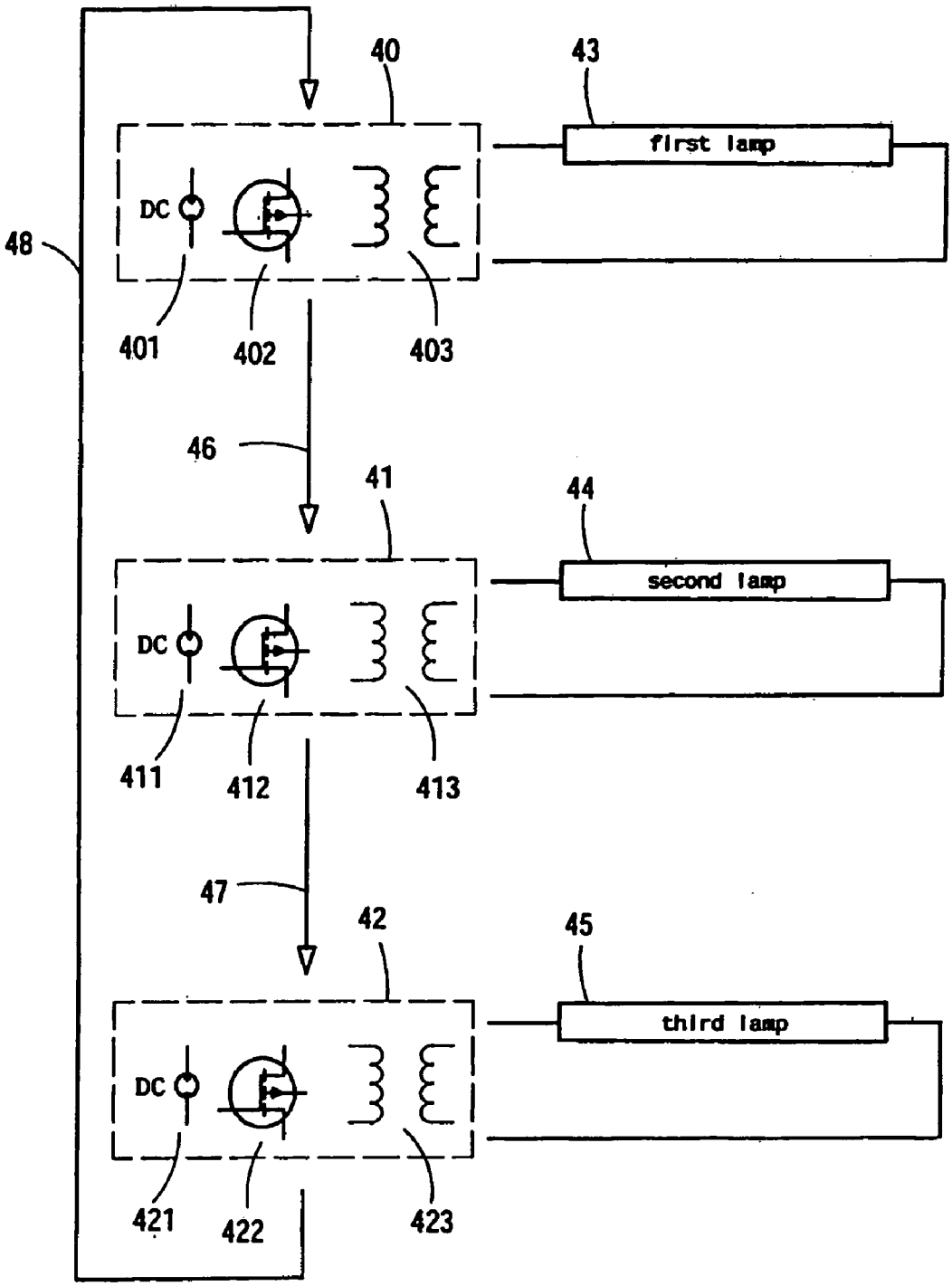
FIG. 4 is a schematic block diagram illustrating the connection of three power amplification units and three lamps according to the invention.

Referring to FIG. 3, there is shown a driving circuitry of a frequency synchronization device for an LCD that uses three lamps according to the invention. The configuration substantially has same structure as the above one. The characteristics of this configuration are detailed below. Driving signals of the power amplification elements 25*a* and 25*b* are fed the transformer 21*c* via the conducting wires 28*a* and 28*b*. Driving signals of the power amplification elements 25*c* and 25*d* are fed the transformer 21*a* via the conducting wires 28*c* and 28*d*. Driving signals of the power amplification elements 25*e* and 25*f* are fed the transformer 21*b* via the conducting wires 28*e* and 28*f*. This forms an operating loop. Referring to FIG. 4, there is shown a schematic block diagram illustrating the connection of three power amplification units 40, 41, and 42 and three lamps 43, 44, and 45 according to the invention. Each of the power amplification units is a well known device as described in FIG. 1 in which the first power amplification unit 40 comprises a DC power 401, a power switch 402, and a transformer 403; the second power amplification unit 41 comprises a DC power 411, a power switch 412, and a transformer 413; and the third power amplification unit 42 comprises a DC power 421, a power switch 422, and a transformer 423 respectively.

One of the characteristics of the invention is that a first driving signal 46 is outputted from the first power amplification unit 40 to another power amplification unit, such as the second power amplification unit 41, for controlling; a second driving signal 47 is outputted from the second power amplification unit 41 to another power amplification unit, such as the third power amplification unit 42, for controlling; and a third driving signal 48 is outputted from the third power amplification unit 42 to another power amplification unit, such as the first power amplification unit 40, for controlling respectively. This forms a control loop as shown in FIG. 4, even a control net. Namely, the essential of the present invention is that one of those amplification units is electrically coupled to one of another of those power amplification units and those power amplification units operate with specific frequency relation, such as a same frequency, so that all lamps coupled with those amplification units operate at a same frequency.

Figure 5:
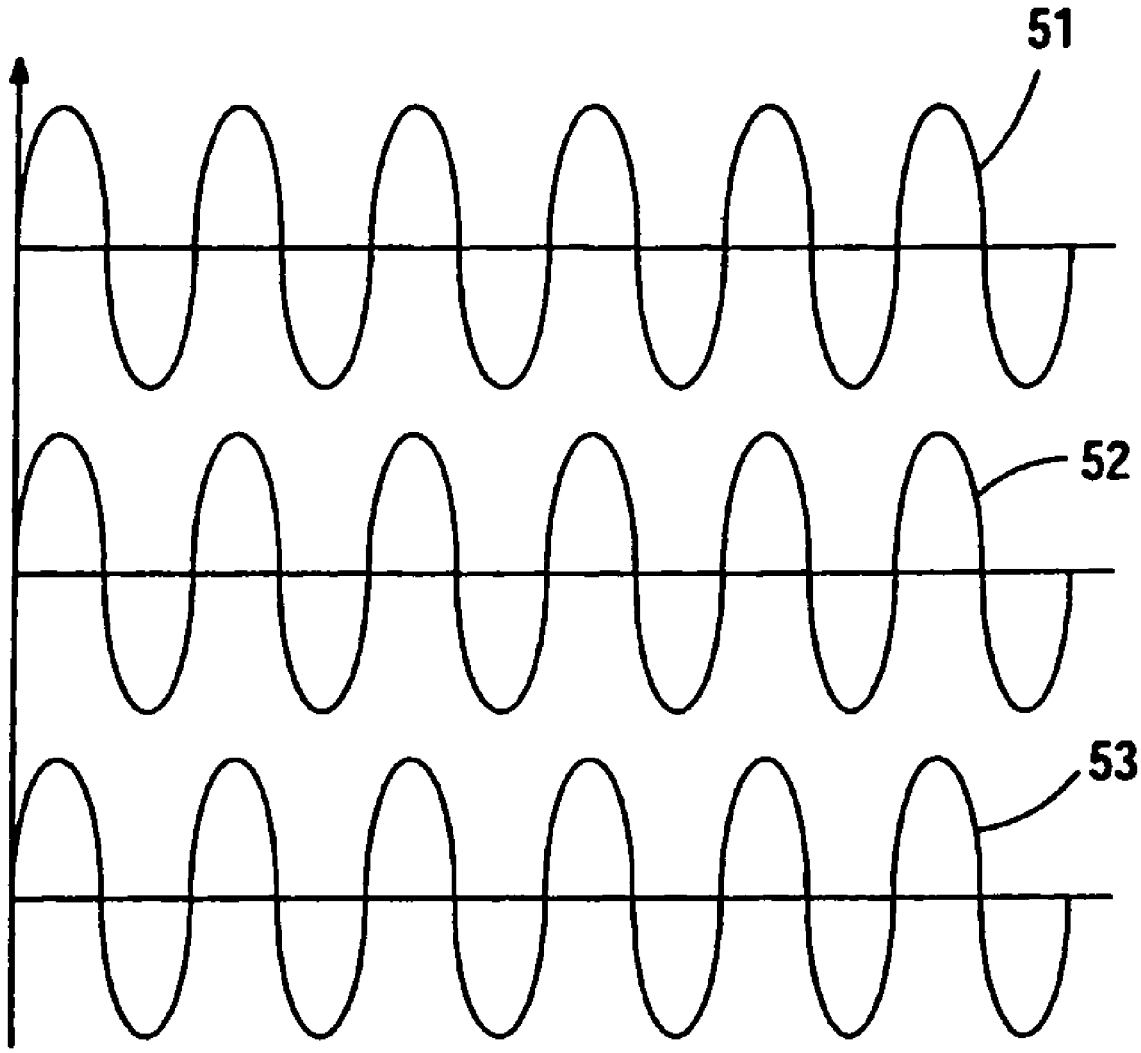
FIG. 5 is a graph illustrating waveshapes of voltage versus time for signals of three lamps and a first driving signal.

Referring to FIG. 5 in conjunction with FIG. 4, voltage operation signals 51, 52, and 53 of the lamps 43, 44, and 45 and the first driving signal 46 are shown. In detail, the voltage operation signal 51 of the second lamp 43, the voltage operation signal 52 of the second lamp 44, and the voltage operation signal 53 of the second lamp 45 are the same in both voltage and frequency. Each of the second and the third driving signals 47 and 48 is the same as the first driving signal 46 in both voltage and frequency because, as stated above, the voltage operation signal 51, 52, and 53 of the lamps 43, 44, and 45 are the same.

Figure 6:
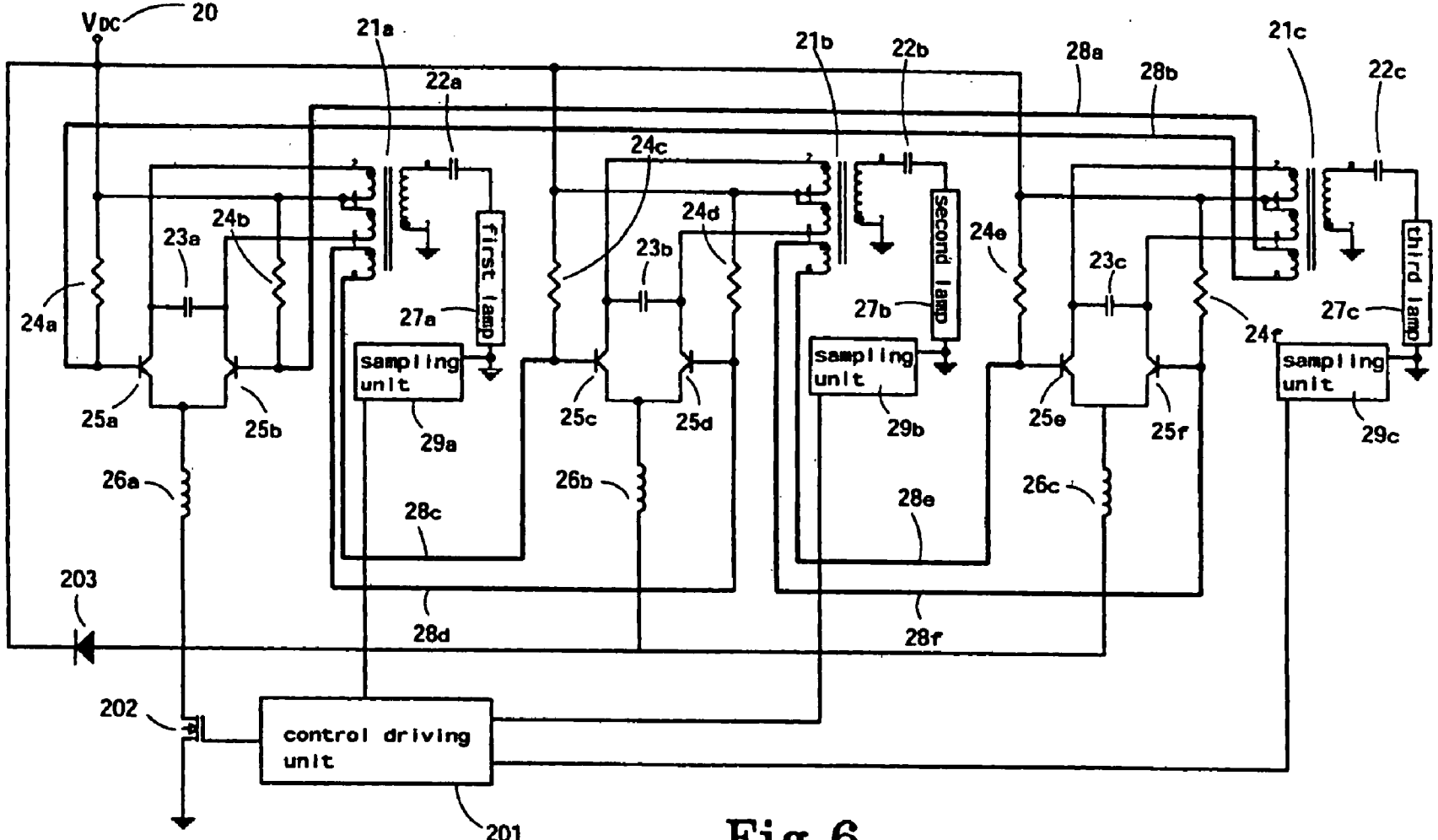
FIG. 6 is a schematic drawing of the circuitry of a frequency synchronization device for LCD that uses three lamps according to a first preferred embodiment of the invention.

Referring to FIG. 6, there is shown a schematic drawing of the circuitry of a frequency synchronization device for LCD according to a first preferred embodiment of the invention. As stated above, the power driving assembly of the first lamp 27*a* comprises a DC power 20, power amplification elements 25*a* and 25*b*, capacitors 22*a* and 23*a*, an inductor 26*a* and a transformer 21*a*. This is the configuration of an LCD having a single lamp. By applying this to an LCD having a plurality of lamps as implemented by the invention, driving signals of the power amplification elements 25*a* and 25*b* can be obtained accordingly. In detail, conduction signals of the power amplification elements 25*c* and 25*d* are fed from a portion of a secondary winding of multicoil (i.e., from pins 1 and 6) of the transformer 21*a*, conduction signals of the power amplification elements 25*e* and 25*f* are fed from a portion of a secondary winding of multicoil (i.e., from pins 1 and 6) of the transformer 21*b*, and conduction signals of the power amplification elements 25*a* and 25*b* are fed from a portion of a secondary winding of multicoil (i.e., from pins 1 and 6) of the transformer 21*c* respectively. The advantageous benefit of the invention is that all lamps 27*a*, 27*b*, and 27*c* can operate in the same frequency by forming a first loop comprised of conductint wires 28*a* and 28*b*, a second loop comprised of conductint wires 28*c* and 28*d*, and a third loop comprised of conductint wires 28*e* and 28*f* and electrically connecting the first, the second, and the third loops together. Moreover, for obtaining a stable current of lamps, a well known current sampling and control technique is employed in which current sampling units 29*a*, 29*b*, and 29*c* for sampling lamp current, a control driving unit 201, a driving element 202, and a diode 203 are provided in the circuitry. This can carry out a feedback of lamp current.

Figure 7:
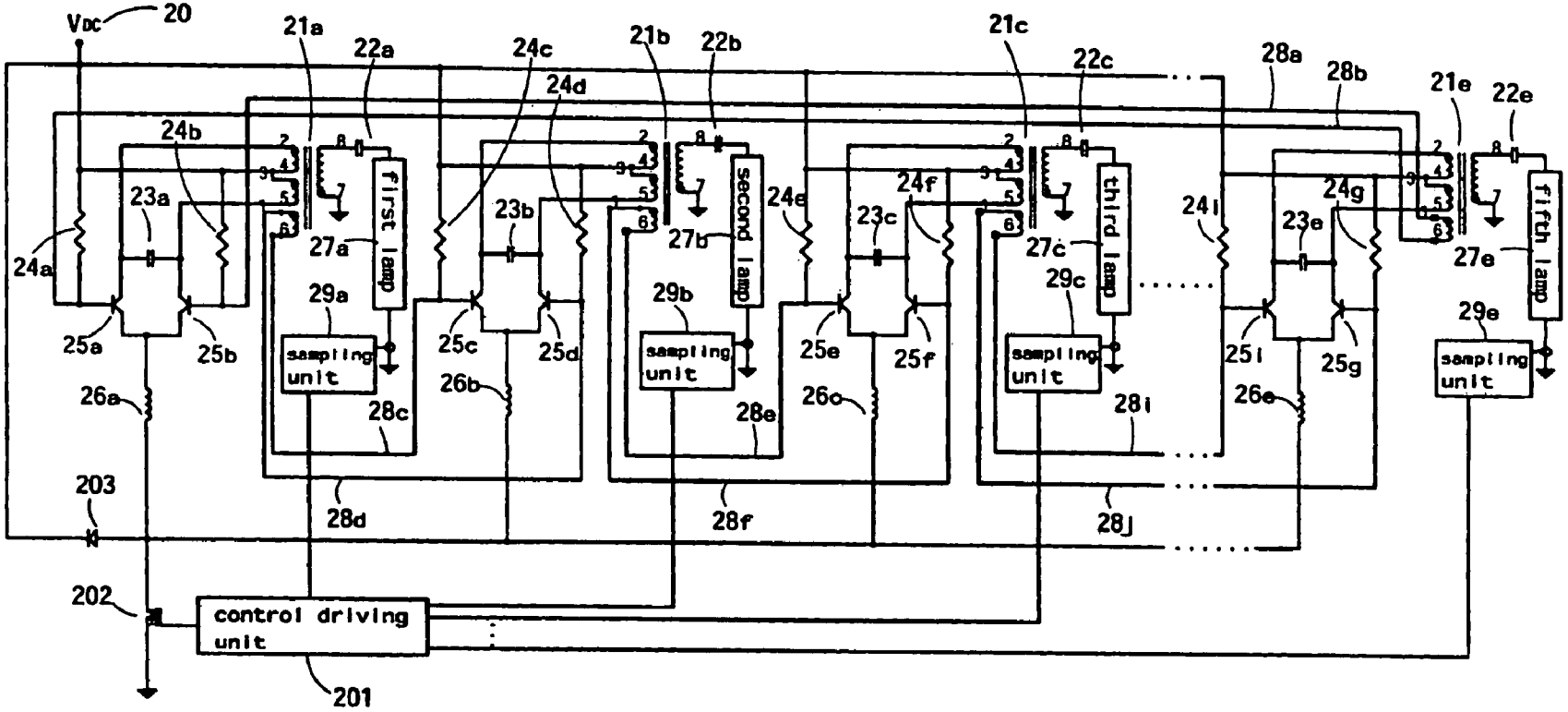
FIG. 7 is a schematic drawing of the circuitry of a frequency synchronization device for LCD that uses more than three lamps according to a second preferred embodiment of the invention.

Referring to FIG. 7, there is shown a schematic drawing of the circuitry of a frequency synchronization device for LCD according to a second preferred embodiment of the invention in which the LCD has more than three lamps (27*a*, 27*b*, 27*c*, 27*e*). The second preferred embodiment substantially has same structure as the first preferred embodiment. Thus a detailed description thereof is omitted herein for the sake of brevity.

The invention can carry out a frequency synchronization operation among a plurality of lamps of LCD and a stable operating current of the lamps without causing a difference frequency distortion. In brief, the frequency synchronization device for a large LCD having a plurality of lamps as background light source as contemplated by the invention has the following advantages: a) A secondary winding of multicoil of a transformer is used as means for initiating and sending driving signals to the lamps so that all lamps can operate in the same frequency. b) Driving signals having the same frequency can be generated without the provision of ICs as experienced in the prior art. c) Both connection and circuitry of the frequency synchronization device are much simplified. d) The driving signals having the same frequency are generated by a resonant chamber consisting of transformers and capacitors. e) Typical lighting loop of a plurality of fluorescent lamps are incorporated into the circuitry of the invention and are improved by the invention. F) Availability of constituent components is much easy and thus the manufacturing cost is reduced significantly due to the above advantage of item e). g) The invention is applicable to an LCD having more than two lamps. h) Lamp current can be effectively controlled and stabilized by incorporating a cost-effective lamp control circuit. i) Finally, the invention is much simplified in terms of the frequency synchronization control of lamps.

While the invention herein disclosed has been described by means of specific embodiments, numerous modifications and variations could be made thereto by those skilled in the art without departing from the scope and spirit of the invention set forth in the claims.

What is claimed is:

1. A frequency synchronization device for a LCD having a plurality of lamps as a background light source, comprising:

a first power amplification unit, said first power amplification unit being electrically coupled to one of said lamps, adapted to generate a first driving signal; and a second power amplification unit, said second power amplification unit being electrically coupled to another of said lamps, adapted to generate a second driving signal;

wherein said first power amplification unit and said second power amplification unit are electrically coupled with each other so that said first power amplification unit is adapted to provide said first driving signal to said second power amplification unit and said second power amplification unit is adapted to provide said second driving signal to said first power amplification unit for causing said lamps to operate at a same frequency.

2. The frequency synchronization device according to claim 1, wherein each of said power amplification units is a DC to AC converter.

3. The frequency synchronization device according to claim 2, wherein said DC to AC converter comprises a DC power, a power switch, and a transformer.

4. The frequency synchronization device according to claim 3, wherein said transformer of said first power amplification unit is adapted to provide said first driving signal to said power switch of said second power amplification unit and said transformer of said second power amplification unit is adapted to provide said second driving signal to said power switch of said first power amplification unit.

5. The frequency synchronization device according to claim 1, wherein each of said power amplification units comprises a DC power, a power switch, and a transformer.

6. The frequency synchronization device according to claim 5, wherein said transformer of said first power amplification unit is adapted to provide said first driving signal to said power switch of said second power amplification unit and said transformer of said second power amplification unit is adapted to provide said second driving signal to said power switch of said first power amplification unit.

7. The frequency synchronization device according to claim 1, wherein said first power amplification unit and said second power amplification unit operate at a same frequency.

8. A frequency synchronization control circuit for a DC to AC converter, comprising:

a plurality of power amplification units adapted to generate a driving signal;

wherein each of said power amplification units is coupled to one of another of said power amplification units and adapted to send said driving signal to said corresponding power amplification units for causing said power amplification units operate at a same frequency.

9. The frequency synchronization control circuit according to claim 8, wherein each of said power amplification units comprises a DC power, a power switch, and a transformer.

10. The frequency synchronization control circuit according to claim 9, wherein said transformer of one of said power amplification units is adapted to provide said driving signal to said power switch of said corresponding power amplification unit.

11. A frequency synchronization device for a LCD having a plurality of lamps as a background light source, comprising:

a plurality of power amplification units, each of said power amplification units being electrically coupled to one of said lamps, adapted to generate a driving signal; and wherein each of said power amplification units is coupled to one of another of said power amplification units so that said each of power amplification unit is adapted to provide said driving signal to said corresponding power amplification units for causing said lamps operate at a same frequency.

12. The frequency synchronization device according to claim 11, wherein each of said power amplification unit is a DC to AC converter.

13. The frequency synchronization device according to claim 12, wherein said DC to AC converter comprises a DC power, a power switch, and a transformer.

14. The frequency synchronization device according to claim 13, wherein said transformer of one of said power amplification units is adapted to provide said driving signal to said power switch of said corresponding power amplification unit.

15. The frequency synchronization device according to claim 14, wherein all said power amplification units operate at a same frequency.

16. The frequency synchronization device according to claim 11 further comprising a plurality of current sampling units coupled to said plurality of power amplification units for sampling lamp currents.

17. The frequency synchronization device according to claim 16 further comprising a control means coupled to said plurality of power amplification units and said plurality of current sampling units for controlling lamp currents.

18. The frequency synchronization device according to claim 11, wherein each of said power amplification units comprises a DC power, a power switch, and a transformer.

19. The frequency synchronization device according to claim 18, wherein said transformer of one of said power amplification units is adapted to provide said driving signal to said power switch of said corresponding power amplification unit.

20. The frequency synchronization device according to claim 19, wherein all said power amplification units operate at a same frequency.

* * * * *